US006382994B1

(12) United States Patent
Chang

(10) Patent No.: US 6,382,994 B1
(45) Date of Patent: May 7, 2002

(54) ELECTRICAL CONNECTOR HAVING AN EJECTOR FOR WITHDRAWING AN INSERTED ELECTRONIC CARD

(75) Inventor: Jen Jou Chang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,795

(22) Filed: Jun. 27, 2001

(30) Foreign Application Priority Data

Dec. 27, 2000 (TW) ..... 89222561 U

(51) Int. Cl.[7] ..... H01R 13/62
(52) U.S. Cl. ..... 439/157; 439/188; 439/260
(58) Field of Search ..... 439/157, 159, 439/160, 188, 489, 259, 260, 630, 631

(56) References Cited

U.S. PATENT DOCUMENTS 6,004,155 A * 12/1999 Wu ..... 439/188
6,039,599 A * 3/2000 Benjamin et al. ..... 439/630
6,132,229 A * 10/2000 Wu ..... 439/188
6,227,879 B1 * 5/2001 Dong ..... 439/159

* cited by examiner

*Primary Examiner*—Hien Vu
(74) *Attorney, Agent, or Firm*—Wei Te Chung

(57) ABSTRACT

An electrical connector (1) for soldering to a printed circuit board (PCB) comprises a U-shaped shell (10), a first insulating body (20) and a second insulating body (40) both assembled to the shell. A plurality of terminals (30) are insert-molded with the first insulating body. The shell comprises a base (10*a*), a first wing (11) and a second wing (12) both extending from the base. The first insulating body is secured on the base and the second insulating body is secured to the second wing of the shell. The wings include side walls (14, 16) and bottom walls (13, 15). These walls of the shell and a surface of the PCB define a receiving space for insertion of an electrical connector, thereby decreasing the total height of the connector.

10 Claims, 5 Drawing Sheets

ELECTRICAL CONNECTOR HAVING AN EJECTOR FOR WITHDRAWING AN INSERTED ELECTRONIC CARD

BACKGROUND OF THE INVENTION

1. Field of the Invention

The present invention relates to an electrical connector having an ejector for withdrawing an inserted electronic card, and particularly to an electrical connector having a low profile.

2. Description of Related Art

Japanese Patent Application Publication Nos. 2000-251024 and 2000-251025 each disclose an electrical connector soldered to a printed circuit board (PCB). Each connector comprises an insulating housing and a shell enclosing the housing. Each shell defines a receiving space for insertion of an electronic card so as to establish electrical connection between the card and the PCB. However, a total height of the connector is too large for such an electrical connector. This cannot accord with a miniaturization trend of the connector. In addition, a contact portion of the ejector of the connector for contacting with a front end of the card is made of insulating material, so its strength is not enough to endure impact of the front end of the card in frequent inserting and withdrawing operations.

SUMARRY OF THE INVENTION

Accordingly, the object of the present invention is to provide an electrical connector which has a comparatively low profile.

Another object of the present invention is to provide an electrical connector having an ejector for withdrawing an electronic card from the connector, wherein the ejector has a metallic contact portion for contacting with a front end of the card.

In order to achieve the object set forth, an electrical connector for soldering to a printed circuit board (PCB) of the present invention comprises a U-shaped shell, a first insulating body and a second insulating body both assembled to the shell. A plurality of terminals are insert-molded with the first insulating body. The shell comprises a base, a first wing and a second wing both extending from the base. The first insulating body is secured on the base and the second insulating body is secured on the second wing of the shell. Each wing includes a side wall and a bottom wall perpendicularly extending from the side wall. The bottom walls and the side walls of the shell and a surface of the PCB define a receiving space for insertion of an electrical connector. Therefore, the present invention omits a top wall of a shell of prior arts, thereby decreasing the total height of the connector by the height of the top wall. In addition, the connector comprises an ejector having a metallic resilient element, an insulator and a contact portion insert molded with the insulator.

According to above-mentioned features, the first insulating body defines a first receiving slot for retaining the first clip therein. The bottom wall of the first wing upwardly forms a first securing portion at a free end thereof. The first securing portion defines a first securing hole therein. The bottom wall of the first wing of the shell upwardly forms a first clip at the other end thereof. The bottom wall of the second wing upwardly forms a second clip at a free end thereof. The second insulating body defines a second receiving slot at the other end thereof for retaining the second clip. The first insulating body forms a protruding block at an end thereof near the second insulating body. The second insulating body forms a recess for pressing down the protruding block.

Other objects, advantages and novel features of the invention will become more apparent from the following detailed description of the preferred embodiment when taken in conjunction with the accompanying drawings.

DETAILED DESCRIPTION OF THE INVENTION

Figure 1:
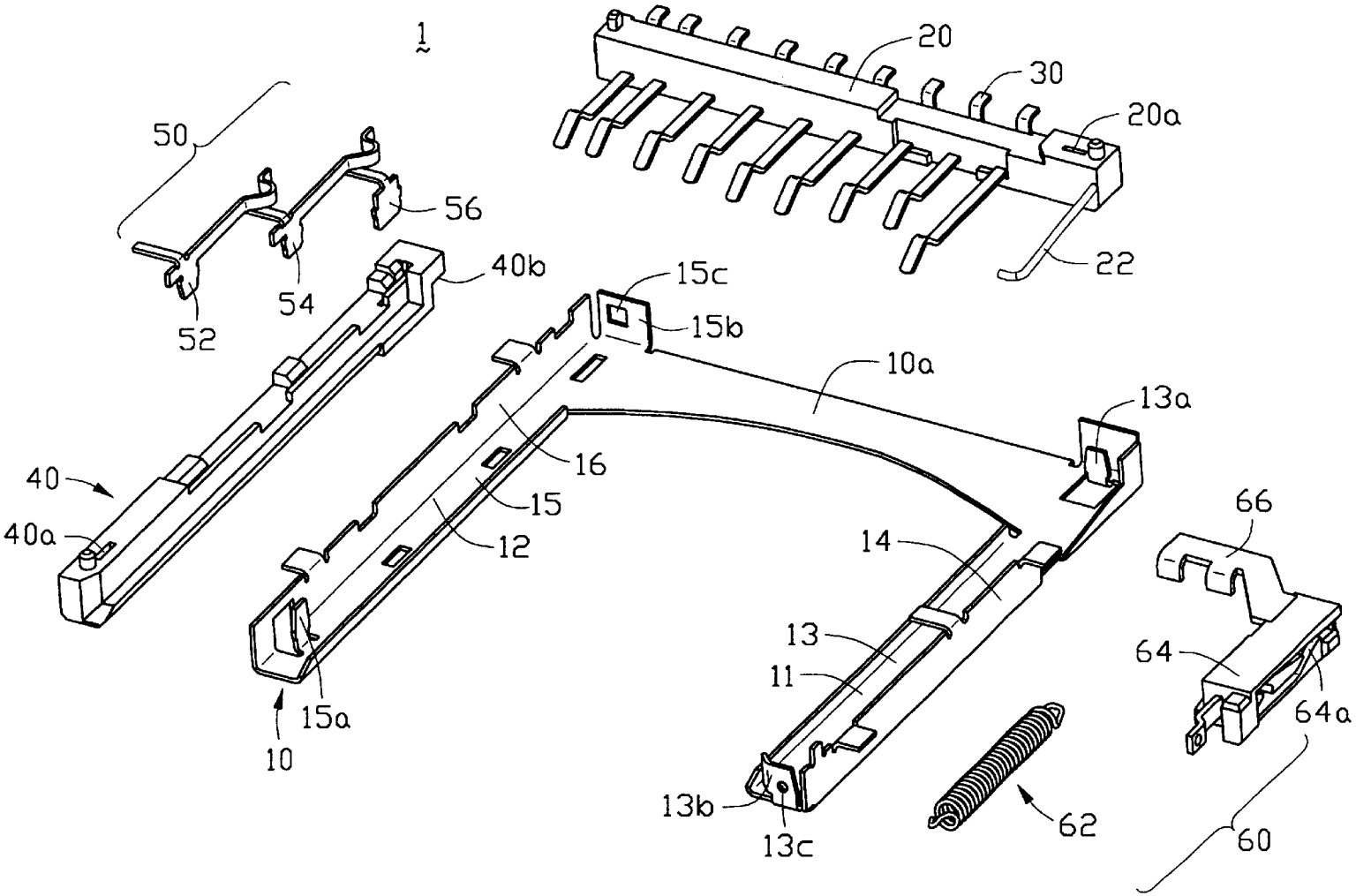
FIG. 1 is an exploded view of an electrical connector of the present invention.

Reference will now be made to the drawing figures to describe the present invention in detail.

Figure 2:
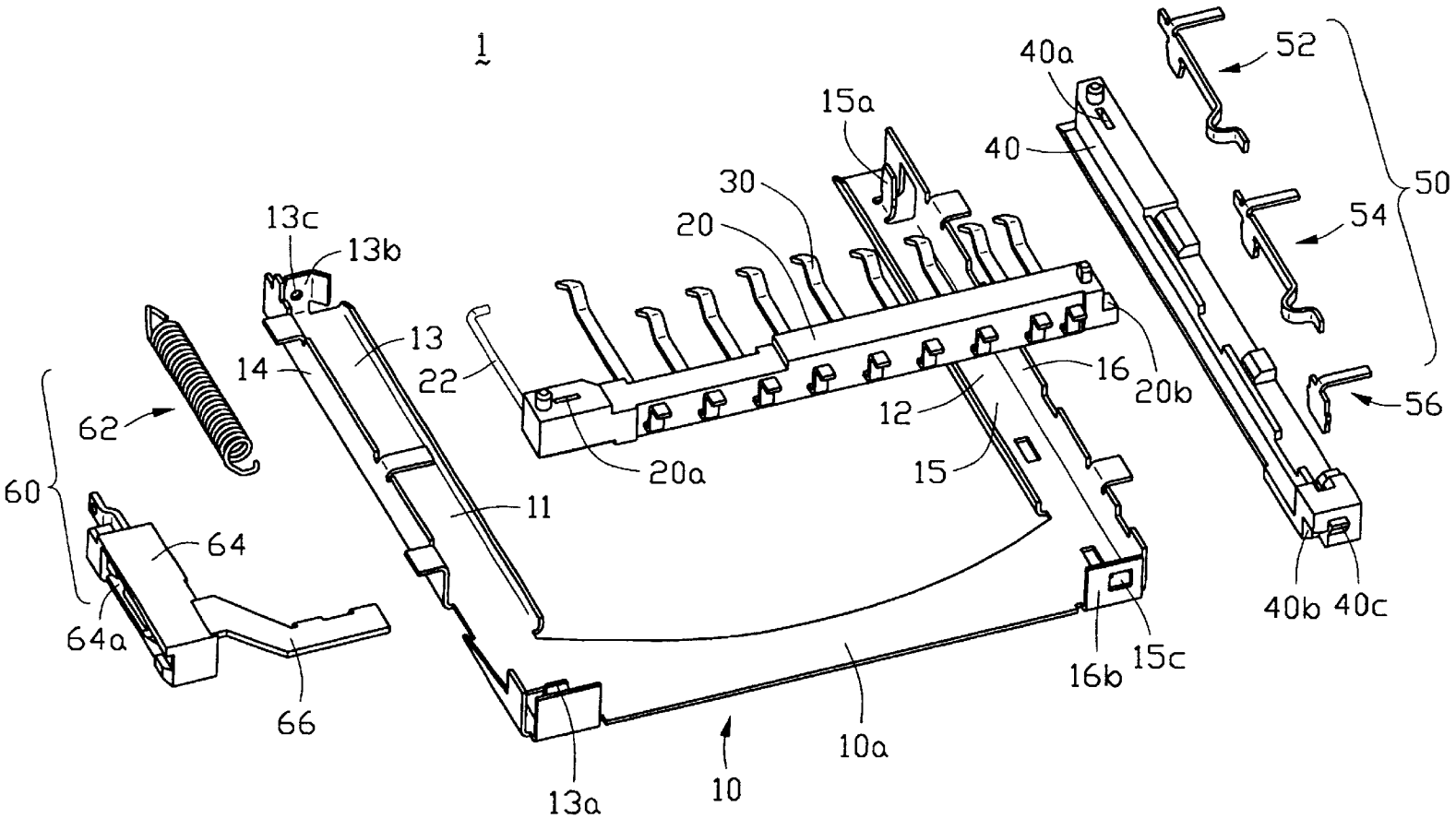
FIG. 2 is another exploded view of the electrical connector of the present invention.
Figure 3:
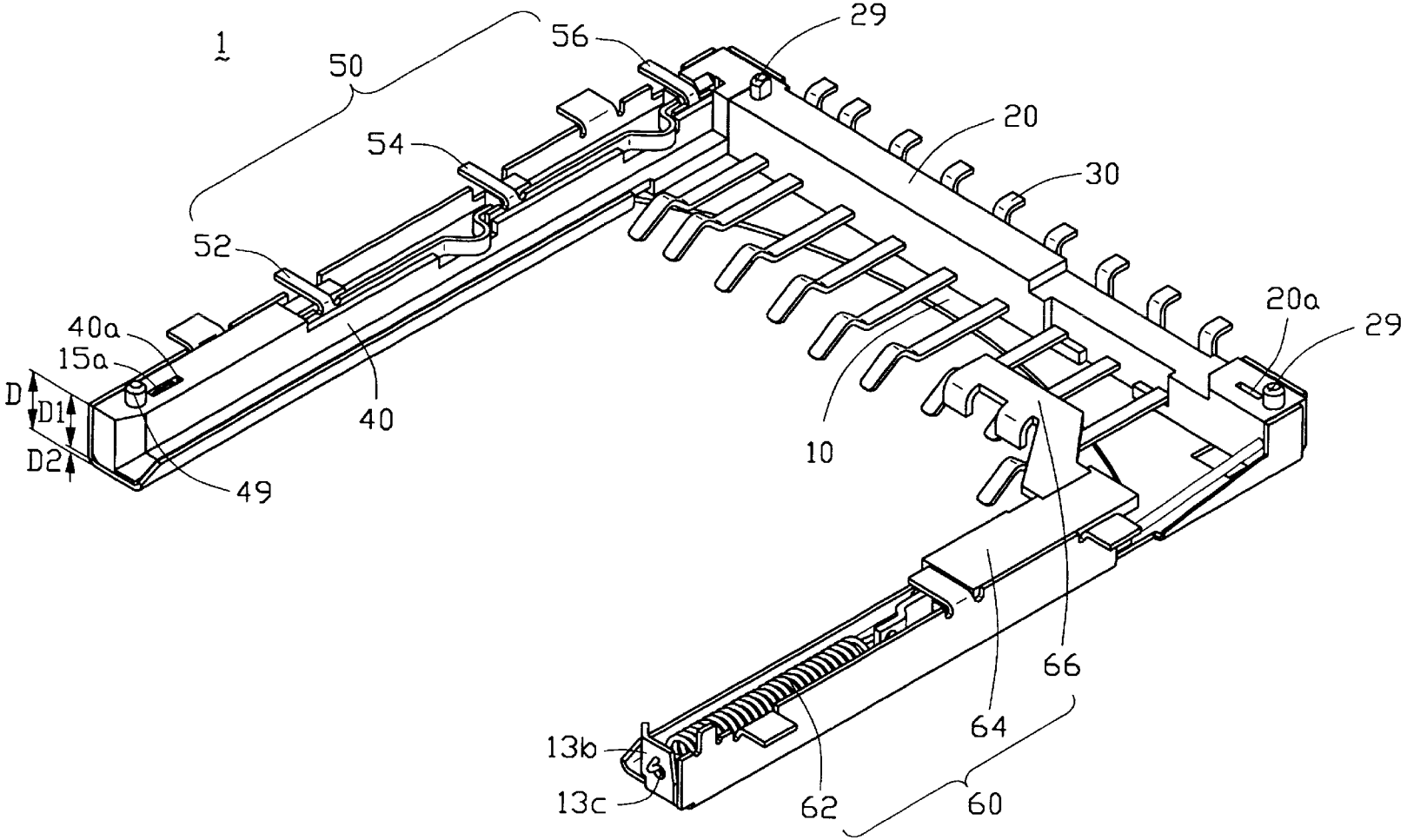
FIG. 3 is an assembled view of the electrical connector of the present invention.

Referring to FIGS. 1 to 3, an electrical connector 1 of the present invention comprises a U-shaped shell 10, a first insulating body 20 assembled on the shell 10, a plurality of terminals 30 partially received within the first insulating body 20, and a second insulating body 40 secured to a side of the shell 10. A plurality of switch terminals 50 are secured to the second insulating body 40. An ejector 60 is secured to the shell 10. The connector 1 is soldered to a printed circuit board (PCB) 2 (shown in fIG. 5) and for insertion of an electronic card (not shown), thereby establishing electrical connection between the PCB 2 and the card.

The shell 10 includes a base 10*a* and a first wing 11 and a second wing 12 both extending from the base 10*a*. The first wing 11 comprises a first bottom wall 13 and a first side wall 14 perpendicularly extending from the first bottom wall 13. The first bottom wall 13 upwardly forms a first securing portion 13*b* at a free end thereof. The first securing portion 13*b* defines a securing hole 13*c*. The first bottom wall 13 also forms an upward-extending first clip 13*a* at the other end thereof. The second wing 12 comprises a second bottom wall 15 and a second side wall 16 perpendicularly extending from the second bottom wall 15. The second bottom wall 15 upwardly forms a second clip 15*a* at a free end thereof and a second securing portion 15*b* upwardly extending from the other end thereof, wherein the second securing portion 15*b* defines a second securing hole 15*c*.

The first insulating body 20 has an elongate configuration and defines a first receiving slot 20*a* at an end thereof corresponding to the first clip 13*a*, and a first protruding block 20*b* on the other end thereof. A sliding bar 22 protrudes from the first insulating body 20 in a direction opposite to an insertion direction of the card.

The second insulating body 40 defines a second receiving slot 40*a* corresponding to the second clip 15*a* of the second wing 12. A recess 40*b* is defined in the second insulating body 40 corresponding to the first protruding block 20*b* of the first insulating body 20. The second insulating body 40 further forms a second protruding block 40*c* corresponding to the second securing hole 15*c* of the second wing 12 of the shell 10.

The switch terminals 50 comprises a first terminal 52, a second terminal 54 and a third terminal 56 which are secured to the second insulating body 40 in sequence.

The ejector 60 includes a resilient element 62, such as a coil spring, secured to the first securing hole 13cof the first wing 11 with one end thereof. An insulator 64 is connected with the other end of the resilient element 62 and has a sliding groove 64*a*. The ejector further comprises a contact portion 66 insert-molded with the insulator 64. The contact portion 66 is made of metal so as to increase its strength to withstand impact of a front end of the card in frequent inserting and withdrawing operations of the card.

Figure 4:
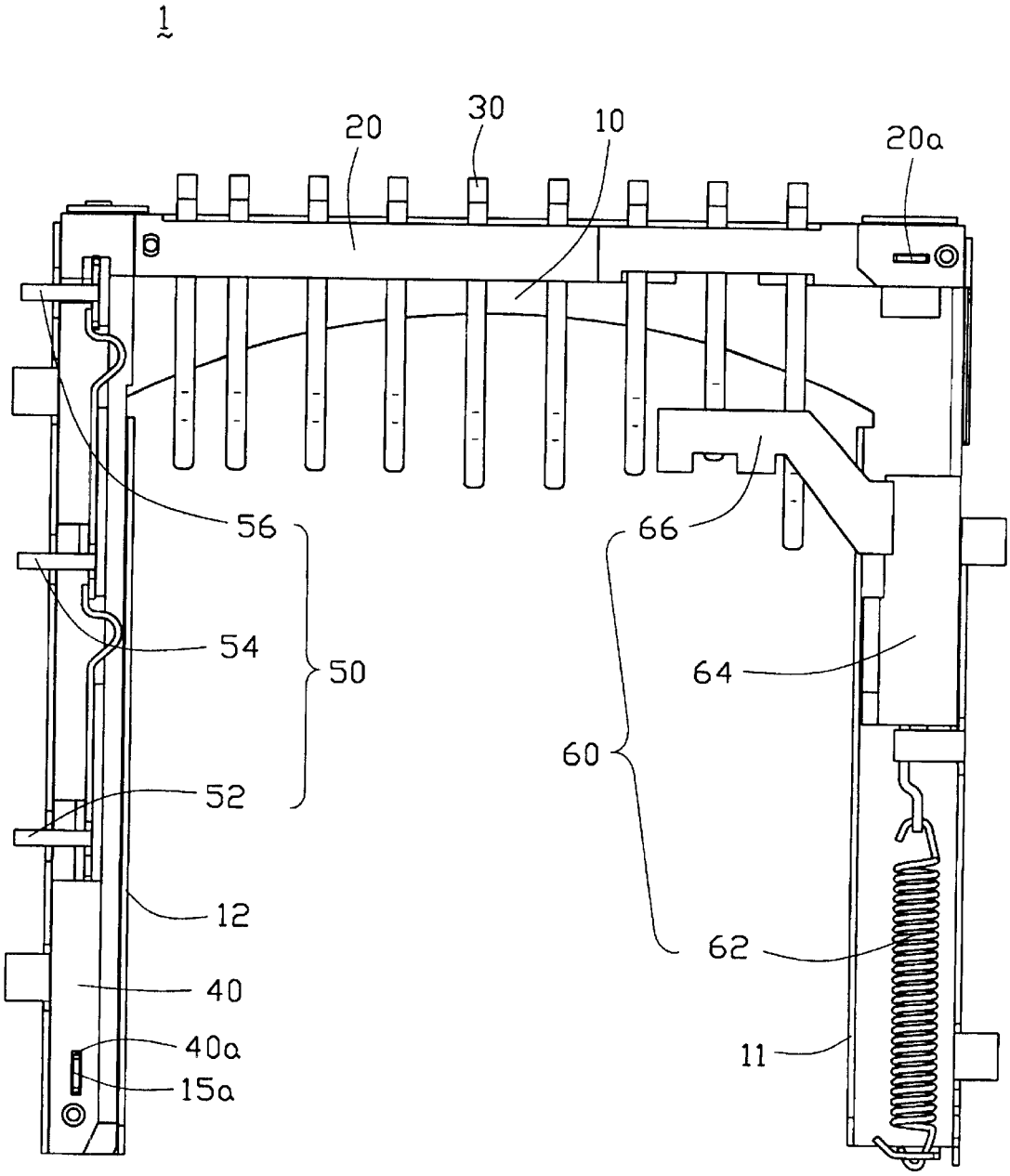
FIG. 4 is a top view of FIG. 3.
Figure 5:
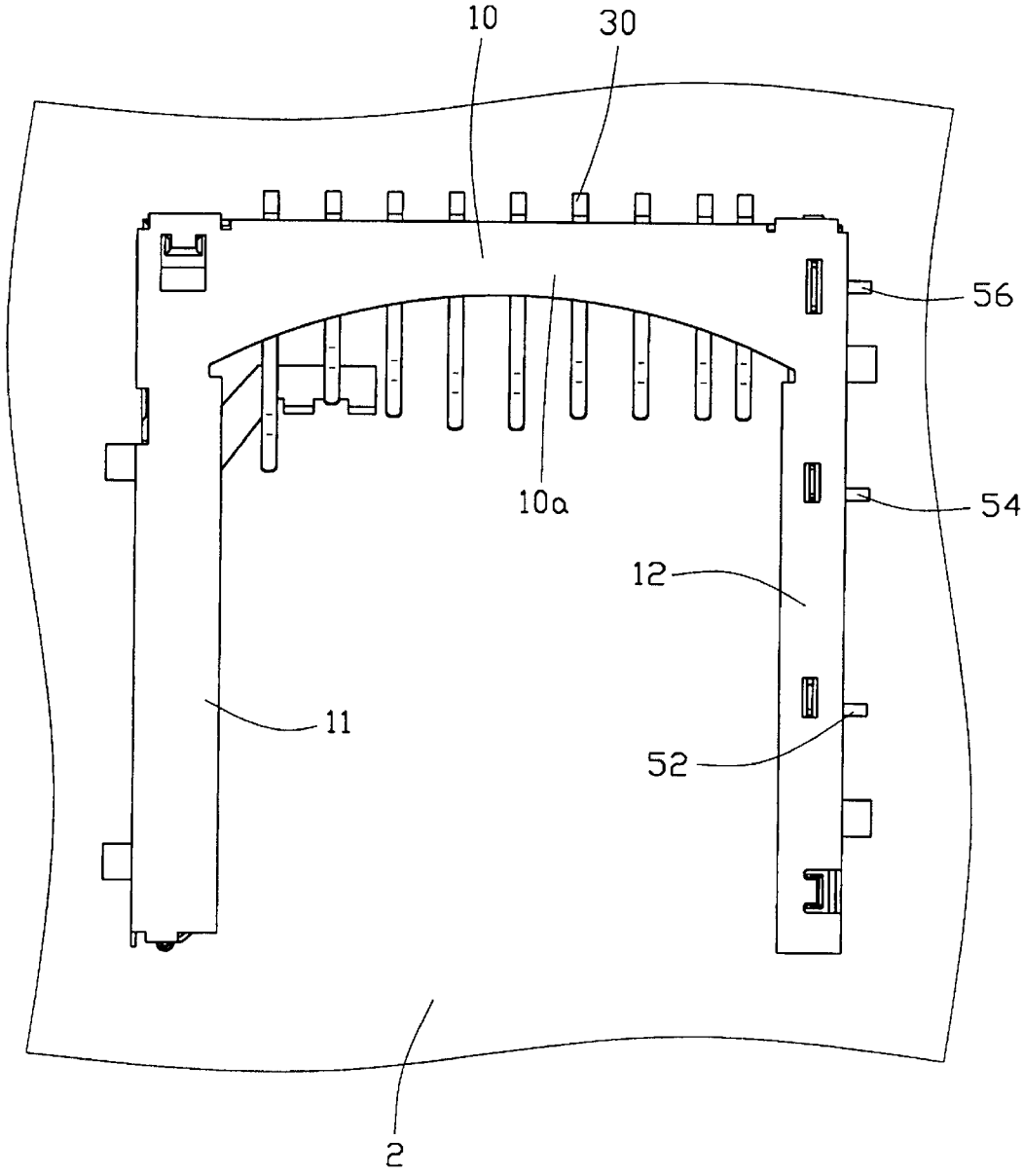
FIG. 5 is a bottom view of FIG. 3, wherein the connector has been soldered to a printed circuit board.

Referring to FIGS. 3 to 5, in assembly, the first insulating body 20 is secured to the base 10*a* of the shell 10, wherein the first receiving slot 20*a* of the first insulating body 20 retains the first clip 13*a* of the first wing 11 of the shell 10. The second insulating body 40 is secured to the second wing 12 of the shell 10, wherein the second receiving slot 40*a* securely retains to the second clip 15*a* of the second wing 12. At the same time, the recess 40*b* of the second insulating body 40 snugly engages with the first protruding block 20*b* of the first insulating body 20, and the second protruding block 40*c* of the second insulating body 40 is engagingly retained within the second securing hole 15*c* of the second wing 12. The switch terminals 52, 54 and 56 are respectively secured to the second insulating body 40, wherein the second terminal 54 electrically connects the first and the third terminals 52 and 56. The ejector 60 is then secured to the first wing 11. Finally, the connector 1 is soldered to the PCB 2. It is noted that the receiving space of the present invention for insertion of the card is defined by the bottom walls 13, 15, the side walls 14, 16 and a surface of the PCB 2, thereby the total height of the connector 1 (excluding positioning posts 49 and 29) D is the sum of D1 (the height of the side wall 15 or 16) and D2 (the height of the bottom wall 13 or 14). This total height (2.4 mm in the present invention is obviously smaller than that of the prior arts (about 2.9 mm).

In use, the card is inserted into the receiving space, and the fire switch terminal 54 is pushed to disconnect from the second terminal 54. Further inserted, the card pushes the contact portion 66 to move toward the insertion direction of the card. At the same time, the contact portion 66 pushed by the front end of the card urges the sliding bar 22 to slide in a first part of the groove 64a of the insulator 64. After touching the terminals 30, the card pushes away the second terminal 54 thereby disconnecting the second terminal 54 and the third terminal 56. Thus, whether the card electrically contacts with the terminals 30 can be ascertained through engagement of the second and the third terminals 54 and 56. When the card is in a working state, the sliding bar 22 of the first insulating body 20 is secured in a middle portion of a front of the groove 64*a* of the insulator 64, whereby the resilient element 62 is stretched. To withdraw the card, the card is further inserted into the connector to disengage the sliding bar 22 from the middle portion of the front of the groove 64*a* and return to its original place via a second part of the sliding groove 64*a* because the depth of the second part of the groove 64*a* is deeper than that of the first part of the groove 64*a*. Thus, the card can be easily withdrawn from the connector due to a restoring force of the resilient element acting in a direction opposite to the insertion direction of the card.

The other structures of the terminals 50 and the ejector 60 themselves are generally known in this art, so they will not be detailed herein.

A first advantage of the present invention is that the receiving space for insertion of the electronic card is defined by the bottom walls 13, 15, side walls 14, 16 and the surface of the PCB instead of bottom walls, side walls and top walls as in the prior arts, thereby decreasing a total height of the connector from 2.9 mm to 2.4 mm.

A second advantage of the present invention is that the contact portion 66 of the ejector 60 is made of metal and insert-molded within the insulator 64, thereby strengthen its intensity to prevent it from being damaged by frequent impact of the front end of the card in inserting and withdrawing operations.

A third advantage of the present invention is that the first insulating body 20 and the second insulating body 40 are separately manufactured and then assembled together, thereby decreasing the manufacturing and assembling costs respective to that of the prior arts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the stretching spring 62 can be replaced by a compressing spring located at the opposite end along the front-to-back direction. Or an inversely looped groove may be located in a stationary piece while the sliding bar may be associatively moved along with the contact portion 66 upon which the outward spring force is imposed.

What is claimed is:

1. An electrical connector having an ejector for withdrawing an inserted electronic card, the connector being assembled to a printed circuit board and comprising:

a first insulating body having a plurality of terminals therein;

a second insulating body secured to the first insulating body at one end thereof; and a metal shell including a base, a first wing and a second wing, wherein the first insulating body is secured to the base, and the second insulating body is secured to the second wing of the shell, each wing having a side wall and a bottom wall, and wherein the side walls, the bottom walls and a surface of the printed circuit board together define a receiving space for insertion of the electronic card; wherein the bottom wall of the first wing of the shell upwardly forms a clip at an end thereof connecting with the base, and the first insulating body defines a receiving slot retaining to the clip; wherein the bottom wall of the first wing of the shell upwardly forms a securing portion at an end thereof distal from the base, the securing portion defining a securing hole therein; wherein the bottom wall of the second wing of the shell upwardly forms a clip at an end thereof distal from the base, and the second insulating body defines a receiving slot retaining to the clip; wherein a first switch terminal, a second switch terminal and a third switch terminal are secured to an outer side of the second insulating body in sequence, respectively.

2. The electrical connector as claimed in claim 1, wherein the first insulating body forms a protruding block at an end thereof secured with the second insulating body, and the second insulating body defines a recess engaging with the protruding block.

3. The electrical connector as claimed in claim 1, wherein the bottom wall of the second wing of the shell upwardly forms a securing portion at an end thereof distal from the base, the securing portion defining a securing hole therein, and the first insulating body forming a protruding block engaging in the securing hole.

4. The electrical connector as claimed in claim 1, wherein the ejector is secured to the first wing, the ejector comprising a resilient element connected to a free end of the first wing, an insulator connected to the resilient element, and a contact portion integrally formed with the insulator.

5. The electrical connector as claimed in claim 4, wherein the first insulating body forms a sliding bar at an end thereof near the first wing, the insulator having a sliding groove for confining a controlled sliding movement of the sliding bar therein.

6. The electrical connector as claimed in claim 4, wherein the contact portion is metal and insert-molded with the insulator.

7. An electrical connector for electrically connecting an electronic card to a printed circuit board, comprising:

a first insulating body having a plurality of terminals therein, the body including a sliding bar extending opposite to an insertion direction of the card;

a metal shell having a base, a respective bottom wall extending from each of two ends of the base, and a respective side wall connecting with corresponding bottom wall, the side walls and the bottom walls together defining a receiving space for insertion of the card; and an ejector assembled to one of the bottom walls of the shell and comprising a metallic contact portion, an insulator integrally formed with the contact portion and having a sliding groove, and a resilient element connected between an end of the insulator and a free end of one of the bottom walls; wherein when the card is inserted into the receiving space, a front end of the card pushes the contact portion of the ejector and moves the insulator rearwardly to a secured position where the sliding bar is secured within the groove and the resilient element is stretched; and when the card is further pushed rearwardly and released, the sliding bar disengages from the secured position and the insulator is returned by the resilient element to an original position, thereby withdrawing the card out of the connector; wherein the connector comprises a second insulating body secured to the first insulating body at an end thereof, the first insulating body is secured to the base of the shell, and the second insulating body is secured the other of the bottom walls of the shell; wherein the first insulating body defines a receiving slot at an end thereof distal from the second insulating body, and the base of the shell defines a clip retained within the receiving slot; wherein a first switch terminal, a second switch terminal and a third switch terminal are secured to an outer side of the second insulating body in sequence, respectively.

8. The electrical connector as claimed in claim 7, wherein the first insulating body forms a protruding block at an end thereof secured with the second insulating body, and the second insulating body defines a recess retaining to the protruding block.

9. The electrical connector as claimed in claim 7, wherein the second insulating body forms a protruding block at an end thereof secured with the first insulating body, and the other of the bottom walls of the shell forms a securing portion and defines a securing hole therein for retaining to the protruding block therein.

10. The electrical connector as claimed in claim 9, wherein the second insulating body defines a receiving slot at an end distal from the first insulating body, and the other of the bottom walls of the shell forms a clip retaining to the receiving slot.

* * * * *